US005803630A

United States Patent [19]

Barrus et al.

[11] Patent Number: 5,803,630

[45] Date of Patent: Sep. 8, 1998

[54] PRINTER HAVING AN IMPROVED SHUTTLE POSITION SENSOR

[75] Inventors: Gordon Brent Barrus, San Juan Capistrano; Robert P. Ryan, Mission Viejo; Kevin P. Moore, Anaheim, all of Calif.

[73] Assignee: Printronix, Inc., Irvine, Calif.

[21] Appl. No.: 712,453

[22] Filed: Sep. 11, 1996

Related U.S. Application Data

[63] Continuation-in-part of Ser. No. 512,367, Aug. 8, 1995, Pat. No. 5,666,880.

[51] Int. Cl.[6] ..... B41J 9/04

[52] U.S. Cl. ..... 400/323; 400/279; 101/93.16

[58] Field of Search ..... 101/93.04, 93.05, 101/93.14, 93.15, 93.16; 324/207.2, 207.25, 207.22; 400/279, 320, 322, 323

[56] References Cited

U.S. PATENT DOCUMENTS

| | | | |
|---|---|---|---|
| 3,941,051 | 3/1976 | Barrus et al. | 101/93.04 |
| 4,463,300 | 7/1984 | Mayne et al. | 318/687 |
| 4,498,793 | 2/1985 | Barrus et al. | 400/320 |
| 4,749,294 | 6/1988 | Barrus et al. | 400/322 |
| 4,854,756 | 8/1989 | McCrimmon, Jr. et al. | 400/322 |

*Primary Examiner*—Edgar S. Burr
*Assistant Examiner*—Steven S.. Kelley
*Attorney, Agent, or Firm*—George F. Bethel; Patience K. Bethel

[57] ABSTRACT

A dot matrix printer having a plurality of hammers forming in part a hammerbank, with a motor for driving the hammerbank, and a controller for releasing the hammers for printing on a print media. A counterbalance is mechanically linked to the hammerbank for balancing it during movement. Lands and grooves are connected for rotation with the motor. A sensor sends pulses corresponding to the lands and grooves for controlling the hammerbank movement. The hammerbank is linked to the position of the lands and grooves as mechanically connected to the motor.

19 Claims, 8 Drawing Sheets

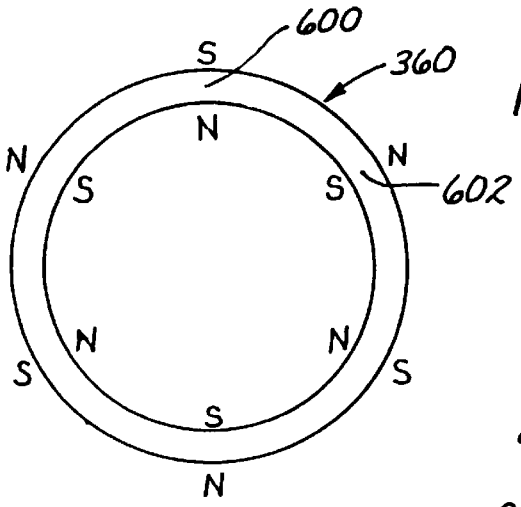
FIG. 10
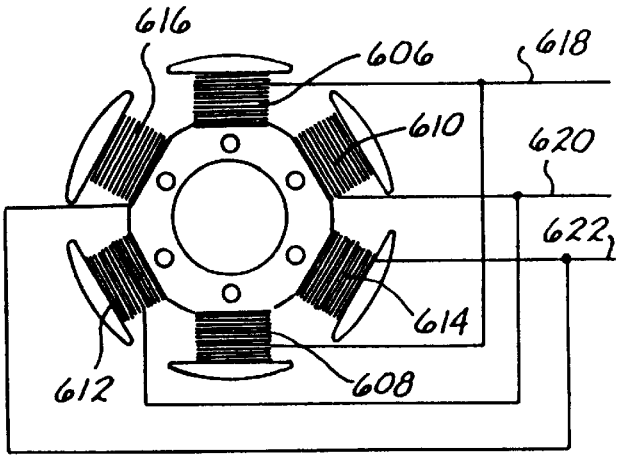
FIG. 11A
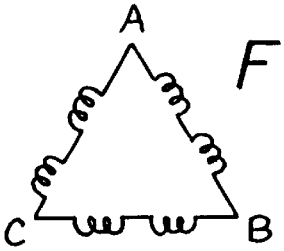
FIG. 11B
FIG. 11D
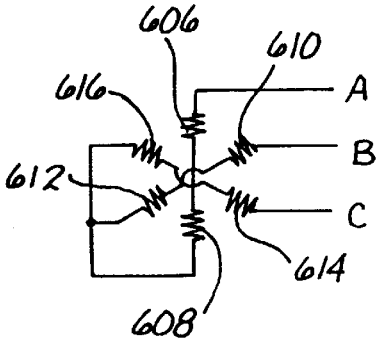
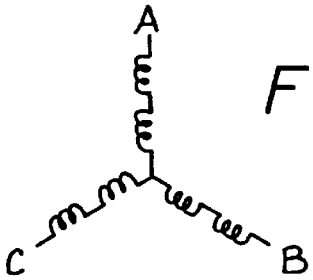
FIG. 11C

PRINTER HAVING AN IMPROVED SHUTTLE POSITION SENSOR

This application is a Continuation in Part of U.S. patent application Ser. No. 08/512,367 as filed Aug. 8, 1995, now U.S. Pat. No. 5,666,880, entitled Integrally Driven and Balanced Line Printer.

BACKGROUND OF THE INVENTION

1. FIELD OF THE INVENTION

The field of this invention lies within the printer art. More particularly, it lies within the art of dot matrix printing wherein numerous dots are printed on a print media such as a sheet of paper to provide for an alpha numeric representation thereon. It specifically relates to the field wherein line printers are driven for movement across a print media in order to impress a number of dots thereon as the printer moves reciprocally across the print media.

2. PRIOR ART AND IMPROVEMENTS THEREOVER

The prior art with regard to dot matrix printers encompasses multiple printers of various configurations. Such configurations use various wheels and hammers of various types to impress a dot on a print media. One particular type of printer which is known in the art is a line printer.

Line printers generally have a series of hammers. The series of hammers are implaced on a hammerbank which reciprocally moves across a print media. The print media is advanced across the hammers and is printed thereon by an inked ribbon.

Such hammers are supported on a hammerbank. The hammers are often held in place by a permanent magnet until released or fired. The release or firing takes place by the permanent magnetism holding the print hammers being overcome. The permanent magnetism is overcome by means of coils which receive a drive current to overcome the magnetism of the permanent magnets.

The foregoing action releases the hammers at a given time and causes them to move toward a print ribbon moving across their face. When the print ribbon is impressed by the hammers, it moves against an underlying print media which has the dots printed thereon. The hammers are released and controlled by electronic drivers which cause the coils to function.

The drivers are provided with logic consistent with the particular configuration of the print to be impressed on the print media. The logic can be in the form of local logic control in conjunction with a host and a central and data processing unit integral to the printer.

In the past, it has been known to place a drive motor at an offset location from the hammers of a hammerbank and drive the hammerbank reciprocally by a crank or a connector. The movement is such wherein the crank or connector must move the hammerbank in a reciprocal manner in a sufficiently rapid manner so as to provide high speed printing. To help to accomplish this, a sufficiently strong and reliable connection is provided between the drive means such as the motor and the hammerbank. During reciprocal movement of the hammerbank, it moves in such a manner as to reciprocate and terminate this movement at various positions with regard to the desired effect on the print media. During its course of movement, when considering the mass of the hammerbank and the speed, it has been customary to counterbalance the hammerbank.

The foregoing counterbalances have been placed in a manner so that they can offset the movement of the hammerbank at different portions of its stroke or movement. Such offset relationships have not always been desirable because of the fact that they were offset and not in a compact and tightly oriented relationship to the hammerbank. In effect, the counterbalance although helping to balance the hammerbank was offset to a degree wherein it created forces which caused the printer to vibrate. Various methods have been used to dampen such vibrational forces. However, in most cases, the vibrational forces could only be dampened and not significantly offset in a consistent and balanced manner.

Another problem of the prior art is that the motor's flywheel was not always consistent and balanced with regard to a configuration to provide for smooth and compact mechanical movement. This creates a situation wherein the flywheel was not always such where it provided for a smooth balanced operation between the connecting rod and the hammerbank and counterbalance.

Another drawback of the prior art was that the capability of driving the hammerbank in a reciprocal manner was not accomplished to the extent where the various forces of movement could be readily dampened. In the alternative they could not be driven in such a manner so as to provide for integrated movement wherein one force offset the other as to the counterbalance and hammerbank and/or the connecting rods and the motor.

The prior art incorporated motor drives for the shuttle which had multiple sensors associated with them. Sometimes, the multiple sensors were also placed on the hammerbank. More recently, it has been common to place multiple sensors on the motor in the form of Hall sensors.

Such motors, in the prior art are commonly brushless motors because of their high reliability and efficiency. These motors require sensing devices to detect the position of the rotor of the motor so that the stator can be driven properly. A common sensor that is used is a Hall sensor that is mounted inside the motor in multiple locations. This increases the cost of the motor and is not as effective as this invention.

In other systems, the shuttle or hammerbank required a second sensor to detect the position of the shuttle during the stroke to determine when the hammers needed to be fired.

It is an object of this invention to remove the Hall sensors where those sensors are on or in the brushless D.C. motor. Another object of this invention is to provide for a rotor position by using a low cost shuttle position sensor.

It is another object of this invention to overcome the problems of the prior art by having a flywheel which is integral to the motor. The motor is an inside out motor wherein the stator is on the inside. With the flywheel being on the outside, the inertia is enhanced to maintain the angular velocity of the motor and flywheel once it is up to speed and of course the mechanical elements connected thereto.

The integral motor is enhanced by a ferrite permanent magnet to enhance efficiency. The flywheel is a sintered metal flywheel having a high density without having to machine the flywheel. The permanent magnet is a sintered barium ferrite material formed as a ring with substantial qualities to enable the motor to function over a highly efficient range.

Another object of the invention and a most important consideration is the fact that the motor is directly connected to the connecting rods of the hammerbank and the counterbalance. This connection is through an integrated motor shaft connected to the flywheel. This relationship thereby transmits the inertia of the flywheel directly to the shaft and the connectors. The connectors are each connected to the respective portions of the integrated hammerbank and counterbalance for reciprocal movement thereof. This is accomplished by eccentrically driven connector rods that move 180° degrees in opposite relationship with the eccentrics being formed as part of the motor shaft, and 180° apart from each other.

Another object of the invention is to dynamically balance the system so that the flywheel, eccentrics, and connector rods are all dynamically balanced during their movement. This serves to minimize vibrations and unwanted forces throughout the cyclical movement of the printer.

A further and substantially important object of the invention is to provide for an integral hammerbank with an overlying and surrounding counterbalance. The relationship of the hammerbank and the counterbalance with its overlying relationship allows the structure to be compatibly and integrally balanced between the two respective members namely the hammerbank and the counterbalance. This overlying relationship causes a dynamically coordinated and balanced relationship to be established between them when connected to the connector rods. The invention further establishes close proximity of the hammerbank and counterbalance to the connector rods as an integral unit, for smoother operation. As can be appreciated the more distal an object is driven, the greater the forces are required and thereby greater dampening and other efforts must be undertaken to prevent unwanted forces to be applied to the dynamic system. This invention tends to eliminate such problems.

This invention provides for the integrated hammerbank and counterbalance to be connected with connector rods or drive rods which are in close proximity to each other. The rods drive a dynamically moving system comprised of the hammerbank and counterbalance. This is done in as close a proximity as practical with respect to the drive shaft emanating from the motor. This particular relationship enhances the dynamics so that less vibration and various forces are encountered. The result is to create a dynamically balanced system driven by the motor and connecting rods as an entire integrally formed and balanced system.

Another object of this invention which is significant and important is that the motor, counterbalance and hammerbank are keyed or linked for operation after being placed in a closed loop relationship. This effectively allows an electrically locked position between the motor and the hammerbank. This is effectuated by means of a low cost single sensor that merely senses the position of the rotor of the motor that is in turn keyed to the position of the hammerbank.

For these reasons, the invention is a substantial step over the prior art and enhances line printer functions as well as smoothness of operation, speed of operation, and provides longevity and finer printing for a line printer than had previously been capable in the art.

SUMMARY OF THE INVENTION

In summation, this invention comprises a line printer having an integral hammerbank and an overlying or surrounding counterbalance with a motor and a single sensor, having a flywheel and rotor integrally oriented with it, that drives a motor shaft having integral eccentrics respectively connected to the connector rods for the counterbalance and the hammerbank.

More particularly, the invention comprises an improved line printer having an integral hammerbank with an overlying or surrounding counterbalance interconnected thereto. The counterbalance and the hammerbank are respectively supported for reciprocal movement 180° apart from each other. The respective hammerbank and counterbalance overlie each other so that they move in such a manner wherein one moves within the other in direct underlying and overlying axially aligned relationship. In particular, the counterbalance is formed such that it overlies and surrounds the hammerbank in part which moves reciprocally and axially therein in a position 180° apart from the movement of the counterbalance. This particular movement is such wherein the counterbalance and the hammerbank are integrated for dynamic reciprocally axially aligned movement to prevent offsets and forces being applied thereto which can disturb the dynamic movement of each one respectively.

An integrated motor and flywheel are provided to the invention. The flywheel is on the outside of a circular magnetic ring which overlies a stator for causing the flywheel to move on an integrated basis with the motor shaft connected thereto through the stator. The motor shaft is interconnected to a drive shaft. The drive shaft is provided with two eccentrics thereon.

The two eccentrics on the drive shaft are oriented so that they are 180° out of phase from each other. These eccentrics are connected to bearings within two connector rods.

The two connector rods are each respectively connected to the hammerbank and the counterbalance for reciprocal movement thereof 180° apart. This effectively allows for the drive shaft to turn the connector rods 180° apart from each other and drive the respective hammerbank and counterbalance.

The invention is further enhanced by balancing the counterbalance and the hammerbank on a pair of bearing surfaces and flexures. The bearing surfaces and flexures allow for reciprocal movement on flexible spring connectors while at the same time providing for a smooth bearing operation during lateral movement as the hammerbank and its accompanying counterbalance reciprocate.

This invention in reference to the movement of the motor eliminates redundant sensors. The sensors are eliminated from both the hammerbank as well as in multiple relationship within the motor itself. The elimination of the multiple sensors in the motor itself eliminates the expensive Hall sensors and the need for multiple sensors.

The invention eliminates the use of expensive Hall sensors and multiple sensors by detecting the rotor position using a low cost magnetic position sensor. This sensor can also be in the form of other magnetic, optical, or other types of sensors that sense the position of the rotor of the motor.

In order to enhance the use of a single sensor, extreme accuracy is maintained and orientation of the sensed pulses that are a direct correlation to the position of the rotor as it is connected to the hammerbank. In turn, the hammerbank must be in position with respect to the motor so that the sensor that sends signals as to the position of the rotor of the motor is directly correlated and orientated with the position of the hammerbank.

The entire system is controlled by a host and a central processing unit through detecting movements of the motor rotor as correlated to the hammerbank, causing the system to respond thereto so that the integral unit moves in a smooth, accurately positioned, and low vibration printing movement.

BRIEF DESCRIPTION OF THE DRAWINGS

FIG. 10 shows a view of the relative placement of the magnetic portions of the circular magnet of the motor as to the north and south orientation of the magnetized portions of the ring.

FIGS. 11A through 11D show the electrical connections for the various coils of the stator of the motor of this invention.

DESCRIPTION OF THE PREFERRED EMBODIMENTS

Figure 1:
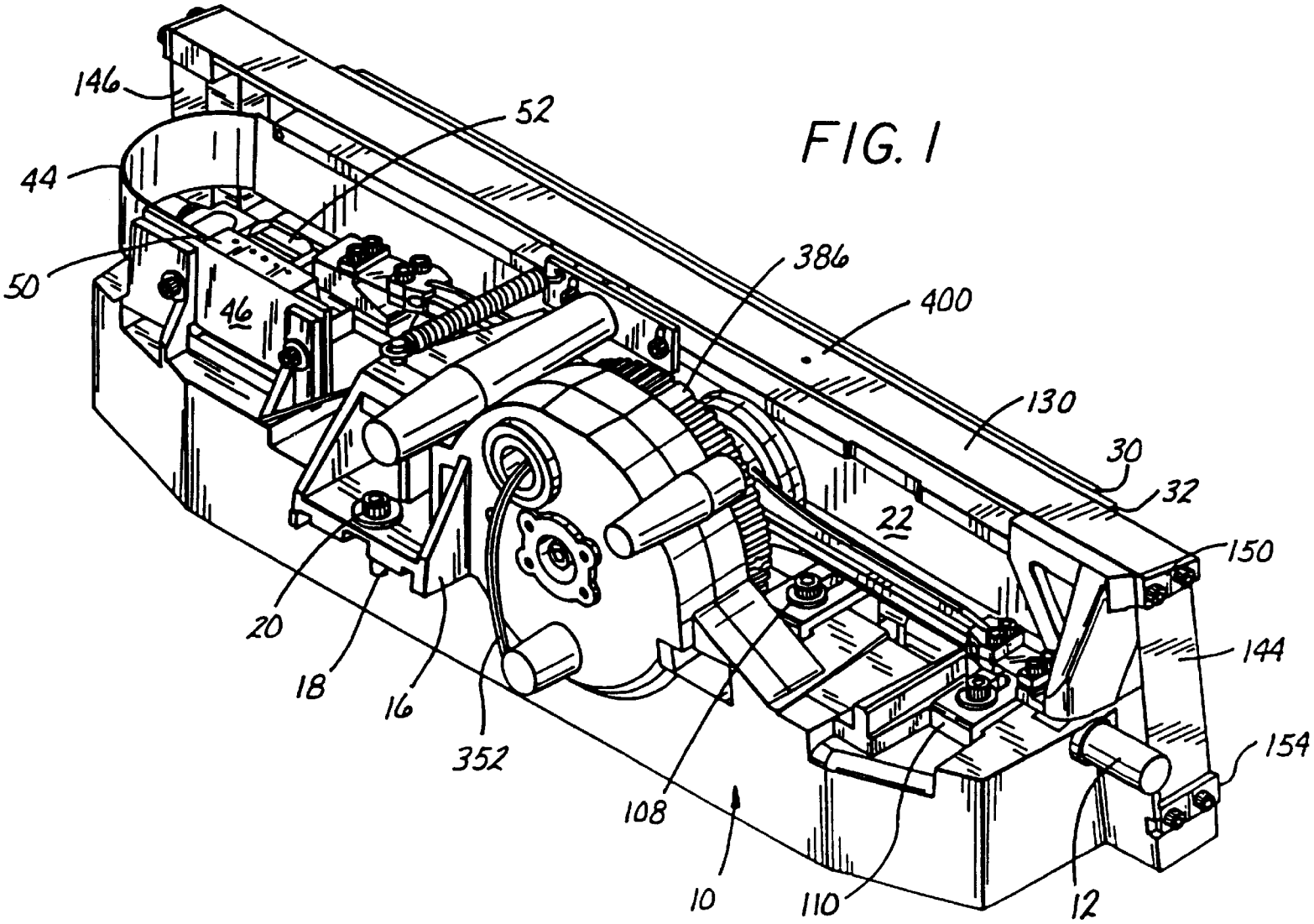
FIG. 1 shows a perspective view of the integrally driven and balanced line printer of this invention with its shuttle frame to be mounted on a mechanical base.
Figure 2:
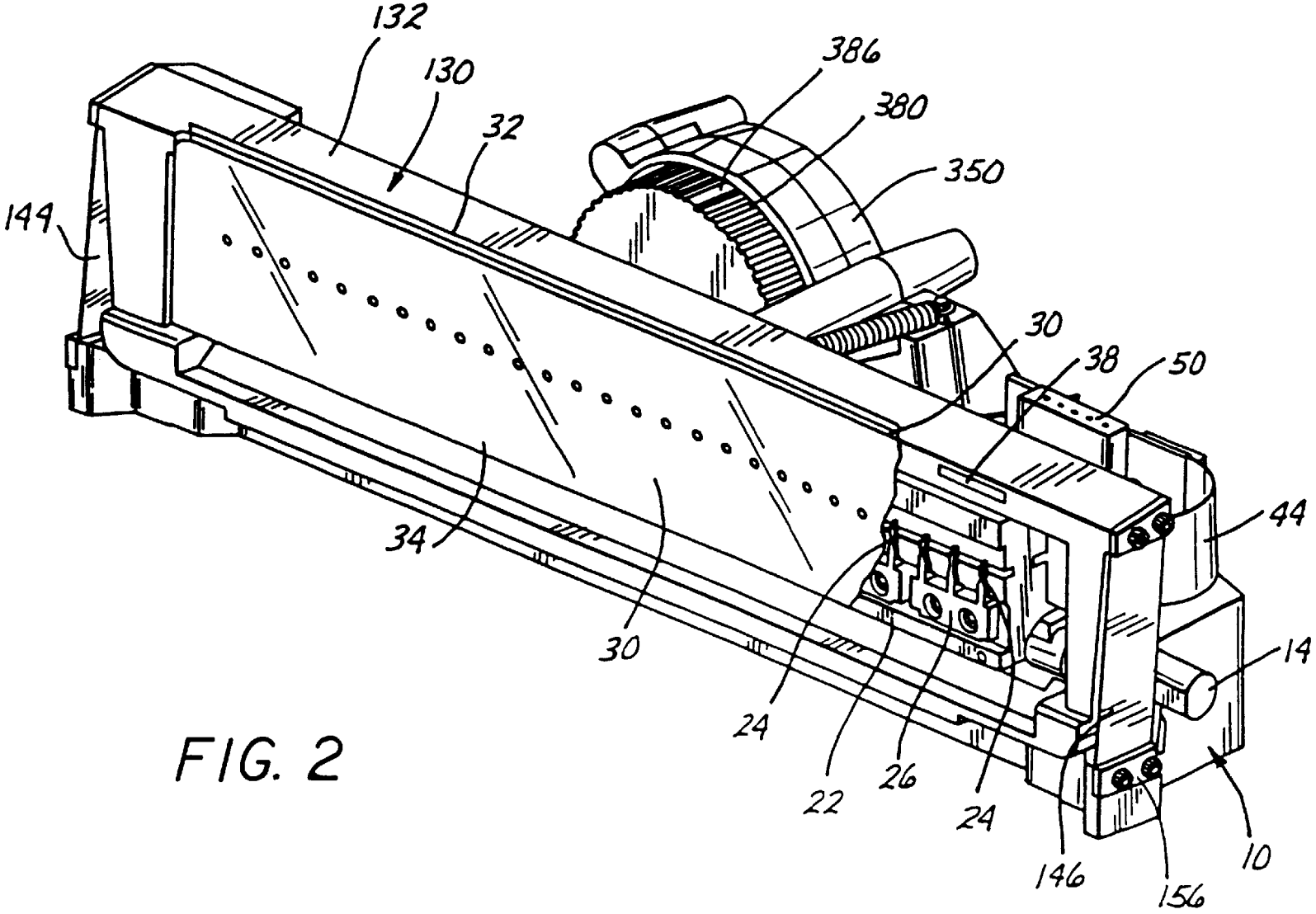
FIG. 2 shows a perspective view of the integrally driven and balanced line printer looking at the opposite side from that shown in FIG. 1, and wherein a fragmented portion of the hammerbank cover and ribbon cover have been removed to expose the hammers of the hammerbank.

Looking more particularly at FIGS. 1 and 2, it can be seen that a base 10 or shuttle frame has been shown. The base 10 or shuttle frame is attached to a mechanical base by means of various attachments. The mechanical base can form a large portion of a cabinet such as a stand alone printer cabinet or a printer mechanical base that can be portable or placed on a surface such as a table.

The shuttle frame or base 10 which attaches to the mechanical base, which is not shown in this case is formed from a die cast alloy. It can be in the form of an aluminum zinc alloy or any other suitable material which will form a firmly fixed and rigid base upon which the printer movement will not be torqued, moved, or unduly provided with forces which will disorient it.

Underlying the shuttle frame or base 10, are a series of cross members in a pattern to provide reinforcement. The entire base 10 can be concave with struts and structures crisscrossing and rigidifying the entire shuttle frame or base 10.

The shuttle frame or base 10 is mounted to a mechanical base by means of mounting or support member shafts 12 and 14. The mounting or support member shafts are held such that they can be rotated on the mechanical base. This allows the entire printer structure formed on the base or shuttle frame 10 to be rotated such that the hammers can be adjusted with respect to a platen or other surface against which they impinge. The two mounting or support member shafts 12 and 14 comprise two portions of a three part mounting.

The third portion of the mounting is a bracket 16 which extends from the shuttle frame or base 10. The bracket 16 is integrally formed with the shuttle frame or base 10 the bracket 16 forms a strong component thereto for maintaining it in rigid relationship with a mounting screw 18 having an allen head 20. The mounting screw 18 threads downwardly against the mechanical base which is not shown to which the entire printer is mounted.

In effect, the base 10 is mounted by the three mountings including the support member shafts 12 and 14 as well as the bracket 16. Thus, adjustment around the rotational axis of mounting or support member shafts 12 and 14 allow for the base to be moved inwardly and outwardly as to the hammerbank's position this adjustment can be made by raising and lowering and adjusting the mounting screw 18.

FIG. 1 shows a hammerbank 22 of this invention from the back thereof. FIG. 2 shows the hammerbank 22 with the hammers exposed. In particular, hammers 24 are formed and supported in this case in a series of three, on frets 26 which are screwed to the hammerbank 22. Such frets 26 can have hammers 24 in multiple numbers significantly higher than the three on fret 26 shown here.

Each hammer 24 as is known in the art comprises a hammer supported and formed on the fret 26 which extends upwardly and provides a pin like member 64. The pin like member 64 impacts against a ribbon which is driven across the face of the hammers 24 to be printed against an underlying print media such as paper.

The ribbon which is impacted and impressed by the hammers 24 passes between a ribbon mask 30 and a hammerbank cover 32. The hammerbank cover 32 and the ribbon mask 30 are held together and joined at the bottom thereof namely at bottom interface 34. In order to secure the combination ribbon mask 30 and the hammerbank cover 32, four magnets, one of which is shown as magnet 38 pull the respective hammerbank cover 32 and ribbon mask 30 against the magnet 38 for securement. This allows for easy removal of the ribbon mask 30 and hammerbank cover 32 for cleaning and access to the hammers 24.

The hammerbank 22 is formed with a permanent magnet therein for holding the hammers 24 until released by coils which are not seen that are activated in part by drivers on an integrated hammerbank circuit board 42. The circuit board 42 has a plurality of electronic components thereon which electrically drive the hammers 24. The circuit board 42 is connected to a flex cable or connection 44 that is in turn connected to a terminator board 46. The terminator board 46 interconnects to a central and data processing unit or other means for driving the printer which in turn is connected to a host as is known in the art.

A power connection through a connector is provided through terminals seen in a terminal block 50, while a logic connection is provided through a logic connector 52.

The circuit board 42 of the hammerbank 22 can be formed in any particular manner provided with local logic, drivers, and various other electronic conditioning means for amply allowing the hammers 24 to fire when necessary in a well timed and readily functioning manner. As previously stated, the hammerbank 22 moves reciprocally across the print media in order to release the hammers and effect printing by the ribbon against the underlying print media.

Figure 7:
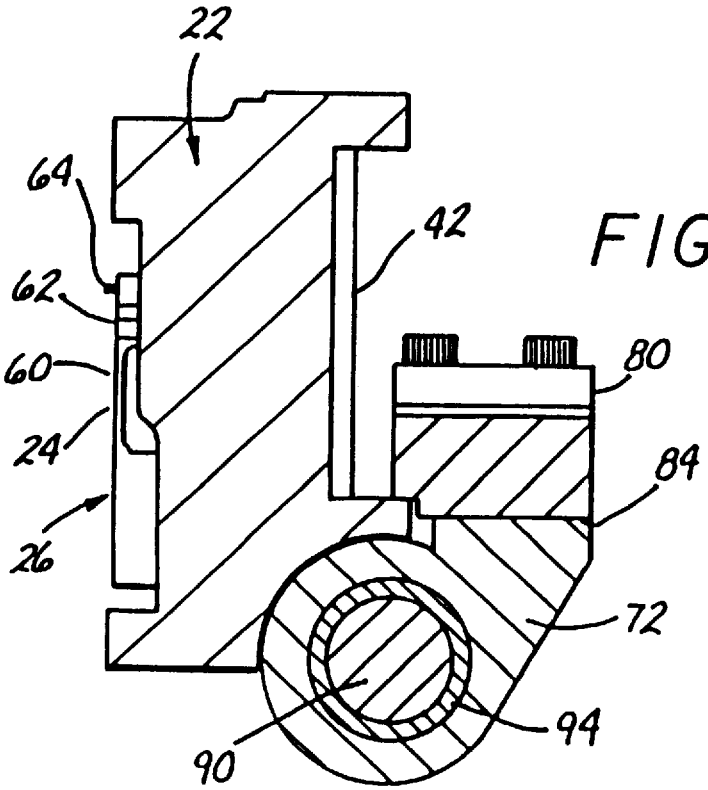
FIG. 7 shows a side sectional view of the linear bearings, shafts and connectors related to the hammerbank as seen in the direction of line 7—7 of FIG. 4.

Looking again more particularly at FIG. 7, it can be seen that the hammerbank 22 incorporates the frets 26 and hammers 24. Each hammer 24 has a narrow neck portion 60 that terminates in an enlarged portion 62 with a tip 64 at the end thereof. The hammerbank 22 is further provided with a printed circuit board 42 which terminates at the flex cable or connection 44 to provide the logic to the components on the printed circuit board 42. These components as previously mentioned allow the hammers 24 to be fired with respect to their being fired through the release of the permanent magnetism drawing them inwardly toward the hammerbank 22.

The hammerbank 22 is secured for driving purposes to two lugs. These two respective lugs are referred to as the driving lug 72 and the trailing lug 74. The respective driving lug 72 and trailing lug 74 are each respectively connected to a concave portion 76 of the hammerbank 22 by means of a high strength glue. The driving lug 72 and trailing lug 74 of course can be attached in any other suitable manner.

Attached to the driving lug 72 is a block driver 80. The block driver 80 is formed and secured to the driving lug 72 by means of the driving lug 72 having a flat portion 84 which is formed as a portion of the driving lug. The driving lug 72 can be seen more effectively in FIGS. 4 and 5 with the block driver 80 secured thereon. Securement of the block driver 80 to the lug flat 84 can be in any suitable manner such as by a bolt attachment or other suitable means.

The respective driving lug 72 and trailing lug 74 each have a shaft 90 and 92 passing therethrough. These shafts 90 and 92 each allow the hammerbank 22 to move reciprocally backwardly and forwardly on the shafts. Each shaft 90 and 92 supports the driving lug 72 and trailing lug 74 respectively with a linear bearing 94 which can be seen such as the linear bearing shown in FIG. 7. The linear bearing 94 is supported within the driving lug 72 in a manner whereby it allows reciprocal movement of the shaft 90. In like manner, the shaft 92 and trailing lug 74 reciprocate with respect to each other on a similar linear bearing 94.

Figure 3:
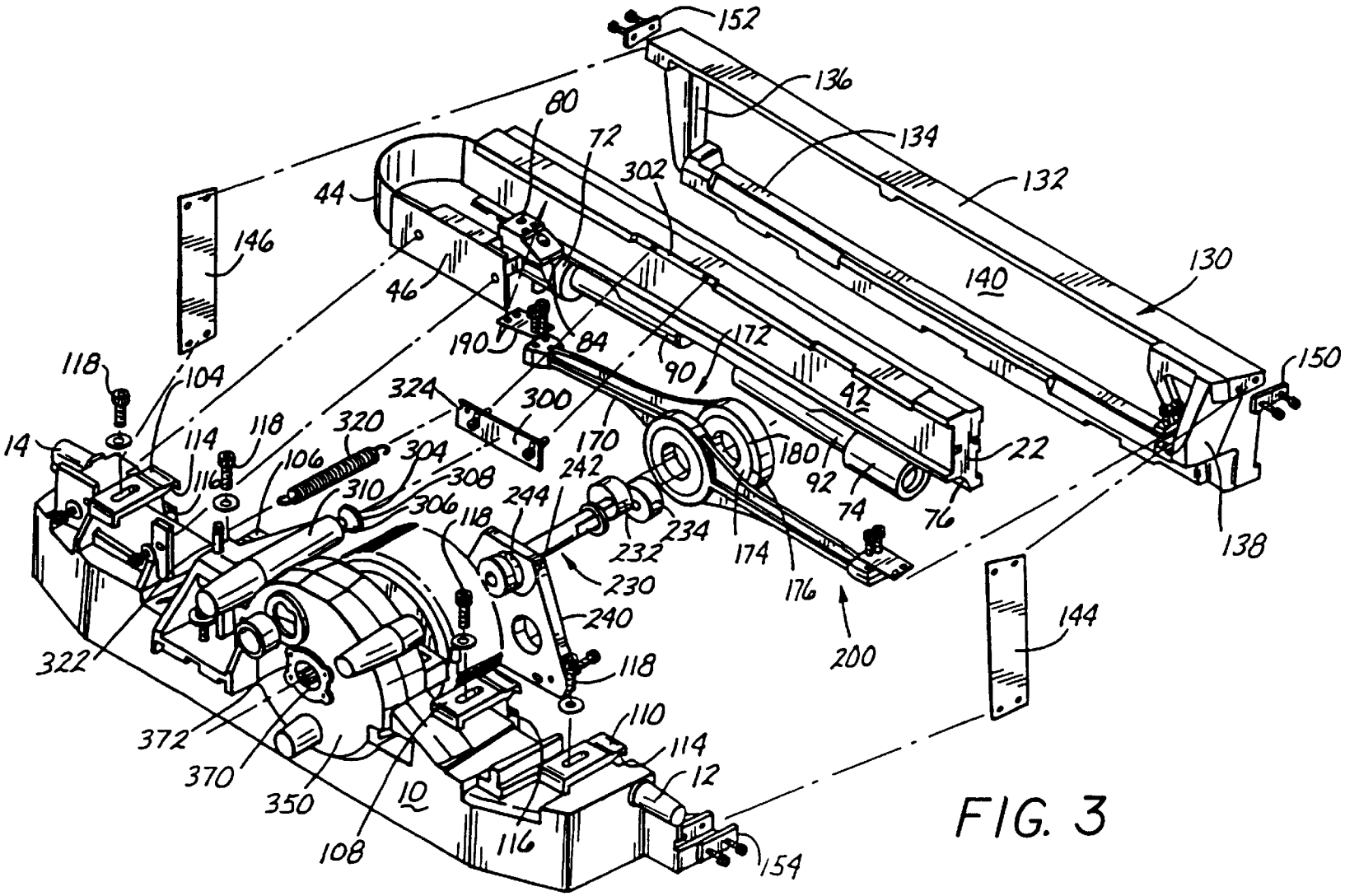
FIG. 3 shows an exploded view of the components of the integrally driven and balanced line printer shown in the same direction as that of FIG. 1.

The shafts 90 and 92 are secured to the shuttle frame or base 10 by means of four respective clamps 104, 106, 108 and 110. Each clamp as can be seen in greater detail in FIG. 3 incorporates a rounded concave interior surface 114 to receive the outer circumference of a portion of the respective shafts 90 and 92. They serve to clamp the shafts 90 and 92 against flats which again can be seen in FIG. 4 namely flats 116. These flats 116 allow the shafts 90 and 92 to be held tightly against the shuttle frame or base 10 and to be secured by the respective screws and a washer such as screws 118 securing each respective clamp 104, 106, 108 and 110 and its attendant shaft.

Both the hammerbank 22 and the counterbalance 130 as will be described hereinafter effectively rely upon a system to drive them reciprocally which shall be described hereinafter in greater detail.

Looking more particularly at the counterbalance to the hammerbank 22, it can be seen that a general rectangular configuration in the form of counterbalance 130 has been shown overlying and surrounding in part the hammerbank 22. This counterbalance 130 moves reciprocally and in opposite direction to the hammerbank 22. The counterbalance 130 is aligned for parallel movement with the hammerbank 22 in close proximate relationship. The hammerbank 22 and counterbalance 130 can be collectively referred to as the shuttle since they comprise the oscillating units that move across the platen for printing purposes.

The counterbalance 130 is a die cast aluminum alloy which forms a frame with an upper member 132 and a lower member 134 which overlies the hammerbank 22. The ends of the counterbalance 130 are provided with upright portions 136 and 138 which roughly define a rectangular opening 140 in which the hammerbank 22 moves backwardly and forwardly.

The counterbalance 130 is supported on the shuttle frame or base 10 by means of flexures, flexural support or spring leaves 144 and 146.

Each support flexure or spring leaf 144 and 146 is secured respectively to the shuttle frame or base 10 by means of clamps 150 and 152. The clamps 150 and 152 have screws with allen heads threaded into openings within the upper portion of the counterbalance 130. Clamps 154 and 156 which can be seen in the reverse view from FIGS. 1 and 3 in FIG. 2 support and counterbalance 130 at the lower position where it is attached to the frame 10.

The support or spring leaves 144 and 146 allow for reciprocal movement backwardly and forwardly of the counterbalance 130. In this manner they provide for not only strong vertical support, but movement in the direction of the length of the counterbalance 130. The flex supported movement of the counterbalance 130 can be seen in FIGS. 4 and 5 wherein the counterbalance 130 support leaves are shown flexed in FIG. 4 in their driving motion.

Returning now to the hammerbank 22 and the way it is driven in reciprocal movement with the counterbalance 130, it can be seen that a first shaft, connector, or drive rod, namely shaft 170 is shown on a connecting rod or crank arm 172. The crank arm or connecting rod 172 has a ball bearing 174 pressed fit with lock tight into an opening 176 provided by a circular loop or opening 180 forming a portion of the crank arm or connecting rod 172.

The connecting rod 172 terminates at a rod spring flexure 190 which can be seen screwed to the end of the connecting rod or crank arm 172 into the top of the block driver 80.

Figure 4:
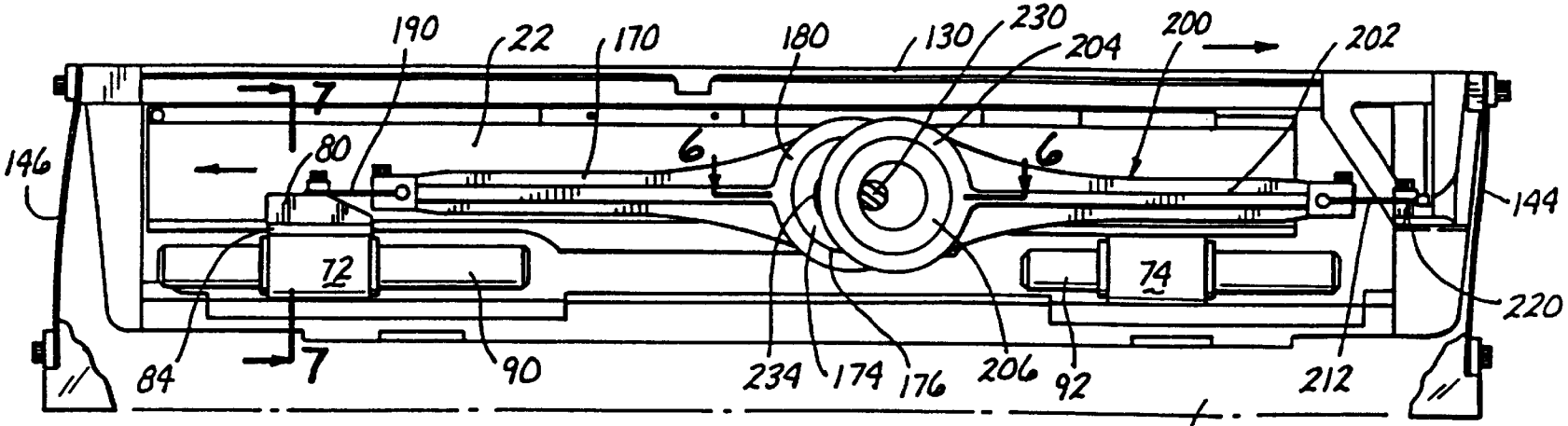
FIG. 4 shows a side elevation view of the connecting rods for respectively driving the hammerbank and counterbalance.
Figure 5:
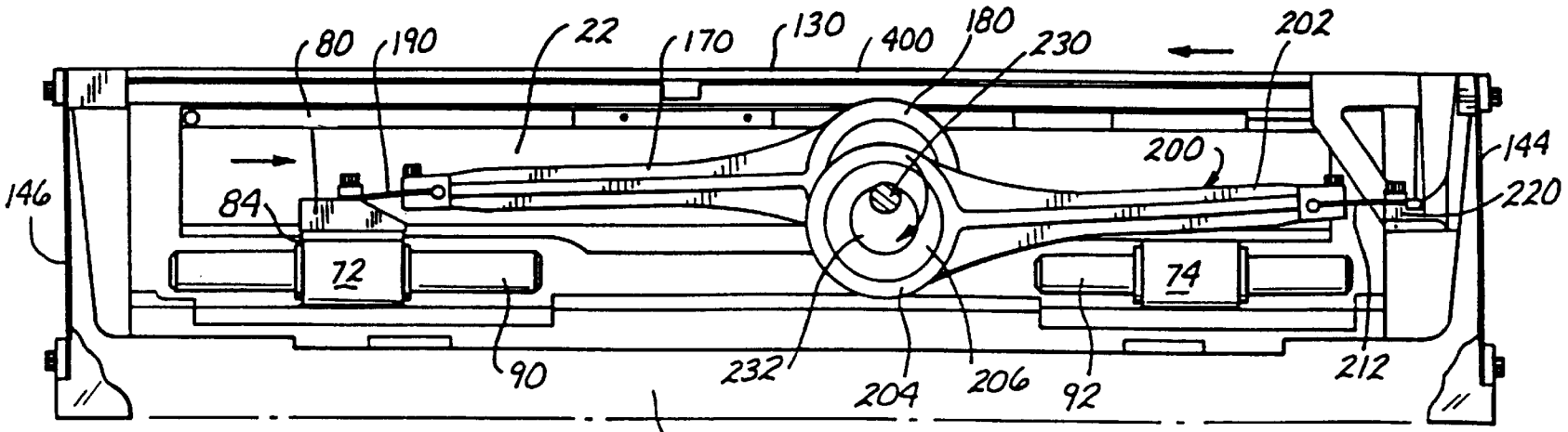
FIG. 5 shows a side elevation view of the respective hammerbank and counterbalance connecting rods driven 90° from the position shown in FIG. 4.
Figure 6:
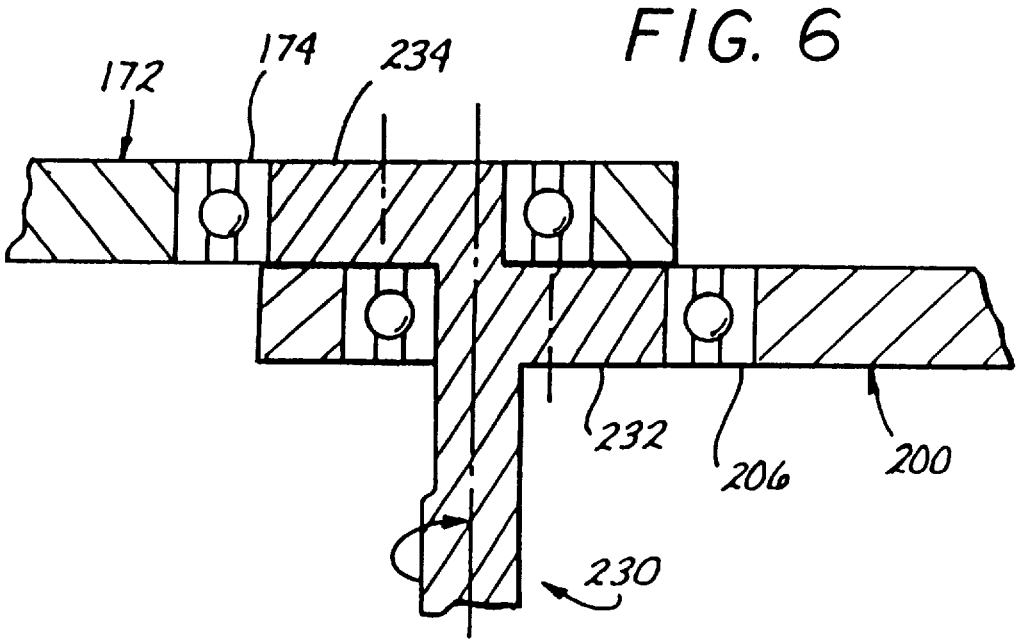
FIG. 6 shows a view of the drive shaft with the eccentrics and bearings thereof as sectioned along line 6—6 of FIG. 4.

In FIG. 4, it can be seen that the movement is such wherein it is in a relatively aligned position with the axis of the connecting rod 172, while in FIG. 5 it is shown flexed during its drive movement.

The crank arm or connecting rod 172 serves to reciprocate the hammerbank 22 in response to the movement of the motor drive shaft as shall be detailed hereinafter.

Looking at the counterbalance 130 it can be seen that a second crank arm or connecting rod 200 is shown having an elongated connection portion 202 with a looped opening 204. The looped opening 204 contains a ball bearing 206. The connecting rod 200 terminates in a rod flexure spring member 212 which is secured by screws to the counterbalance 130 at a clamp 220 held again by screws.

In order to drive the hammerbank 22 with its associated counterbalance 130, the crank arms or connecting rods respectively 172 and 200 are driven in a relationship wherein they are 180° offset from each other as to their reciprocal movement. This is accomplished by a crank or shaft 230 having two integral offset eccentric circular portions. Eccentric 232 is associated with the connector rod 200 and eccentric 234 is associated with crank arm or connector rod 172. These two respective eccentrics 232 and 234 move within the respective ball bearings 206 and 174.

In order to support the crank or shaft 230, a front support plate 240 is utilized having a bearing 242 inserted within an opening 244 for rotational movement. The crank or shaft 230 rotates around an axis established by the center of the crank or shaft 230 thereby causing the eccentric circular portions 232 and 234 to drive respectively crank arms or connecting rod 172 and 200 in a reciprocating manner 180° offset from each other.

The foregoing movement can be seen in FIGS. 4 and 5 wherein the crank arms or connecting rods 172 and 200 are displaced from each at the farthest point of drive to the right, in FIG. 4. In FIG. 5 movement is such wherein the crank or shaft 230 has moved 90° so that the eccentric circular portions 232 and 234 are respectively directly overlying each other.

As can be seen in FIG. 5, the rod spring flexures 190 and 212 have been bent to provide for this eccentric movement of the crank arms or connecting rods 172 and 200 and their respective loop portions 180 and 204 in displaced relationship from each other.

It is now seen that the hammerbank 22 moves reciprocally backwardly and forwardly along the shafts 90 and 92 as supported by the driving lug 72 and the trailing lug 74 within their respective linear bearings. As reciprocal movement is encountered, it can be seen that the hammerbank 22 can rotate around the axis of the shafts 90 and 92 to some extent. In order to prevent this rotation, an anti-rotation plate 300 is utilized. The anti-rotation plate 300 is secured to the hammerbank 22 by two screws on the inset portion 302. The anti-rotation plate 300 provides a surface which can be held tightly in secured relationship against a button disk, or seating surface 304.

The button disk, or seating surface 304 is a disk like member having a rounded or convex portion or surface 306 and a flat portion or surface 308. The rounded portion or surface 306 is seated within an anti-rotation boss member 310. The boss member 310 has a convex rounded cup like seat to receive the rounded portion or disk surface 306 therein. This allows for the disk like member 304 to adjust its flat surface in relationship to the anti-rotation plate 300 so that the two flats are against each other. This provides for various disorientation of positioning while at the same time allowing the plate to move reciprocally across the flat portion or surface 308. The engaged relationship maintains the third portion of the planar orientation of the hammerbank 22.

The hammerbank 22 is biased against the anti-rotational plate 300 by a coil spring 320. The spring 320 is secured to a pin 322 on the shuttle frame or base 10 and through an opening 324 within the anti-rotational plate 300.

In order to rotate the crank or shaft 230, a brushless D.C. motor is utilized that is emplaced within a round or circular housing 350. The circular housing 350 receives the brushless D.C. motor with a portion exposed.

The brushless D.C. motor is driven by three wire leads 352 connected to a circuit board 354 with terminals for the motor. The circuit board 354 has a series of terminals or connectors in order to distribute power to a stator 356. The stator 356 has a number of stator coils 358 that are connected to the circuit board terminals 354. In this manner stepped pulses can be provided for causing the motor to rotate in a stepped relationship.

The motor is an inside out type of motor with a ferrite magnetic ring 360 having north south polarities oriented in the manner shown in FIG. 10. The polarization of the ferrite material is through six sections that are sixty degrees (60°) apart giving a north south orientation so that the motor can be driven with the magnetic ring 360 pulsed to move depending on the output of the stator coils 358 connected to the wire leads 352. This allows for the pulsing of the motor on a continuum when started with a great degree of accuracy and precision. The particular method of start-up and related aspects thereto will be detailed hereinafter and are a substantial portion of this invention.

The motor includes a flywheel portion 364. The flywheel 364 is connected to the motor by means of emplacing it in any suitable manner on the magnetic ring 360. The magnetic ring 360 and the flywheel 364 are referred to collectively as the rotor, and one element can be combined with the other. For instance, the flywheel 364 with the magnetic ring 360 can be combined as one element with the other portions of the flywheel being formed therewith forming a unitary rotor.

The flywheel 364 has a flywheel shaft 366 with an opening 368. The opening 368 receives the crank or shaft 230 passing therethrough and is seated within an opening 370 of the shuttle frame or base 10. The opening 370 has a retainer 372 and a bearing (not seen) which supports the flywheel shaft 366 in order to turn the crank or shaft 230.

The flywheel 364 is made of a sintered material of high density without the requirement of machining. The magnetic material of the magnetic ring 360 is of barium ferrite, to provide high density and strong magnetic properties to the magnetic ring.

The flywheel 364 has a plurality of teeth, notches, or lands and grooves respectively 380, and 382 around the surface thereof. These lands and grooves can be formed on a unitary rotor incorporating the flywheel 364 and ring 360 as a single piece. The lands 380 and grooves 382 are equally spaced around the outer circumference thereof except where an enlarged space or groove 386 can be seen in FIG. 1. This enlarged space or groove 386 can comprise the equivalent of two grooves 382 as placed between the respective lands 380. This is a spacing that is effectually twice as great as a single gap or grove 283. The enlarged space or groove 386 allows for a detection of non-continuity of the lands and grooves 380 and 382. This permits telemetry of the orientation and speed of the flywheel 364 and the shaft with the attendantly oriented hammerbank 22 and counterbalance 130 (the shuttle).

As an alternative the orientations and effect of the enlarged groove 386 can be substituted by an expanded land. The expanded land could have about twice the width of the lands so as to differentiate the pulse as to its width. This in turn can serve to indicate the orientation of the motor in the same manner as the expanded groove 386.

Figure 8:
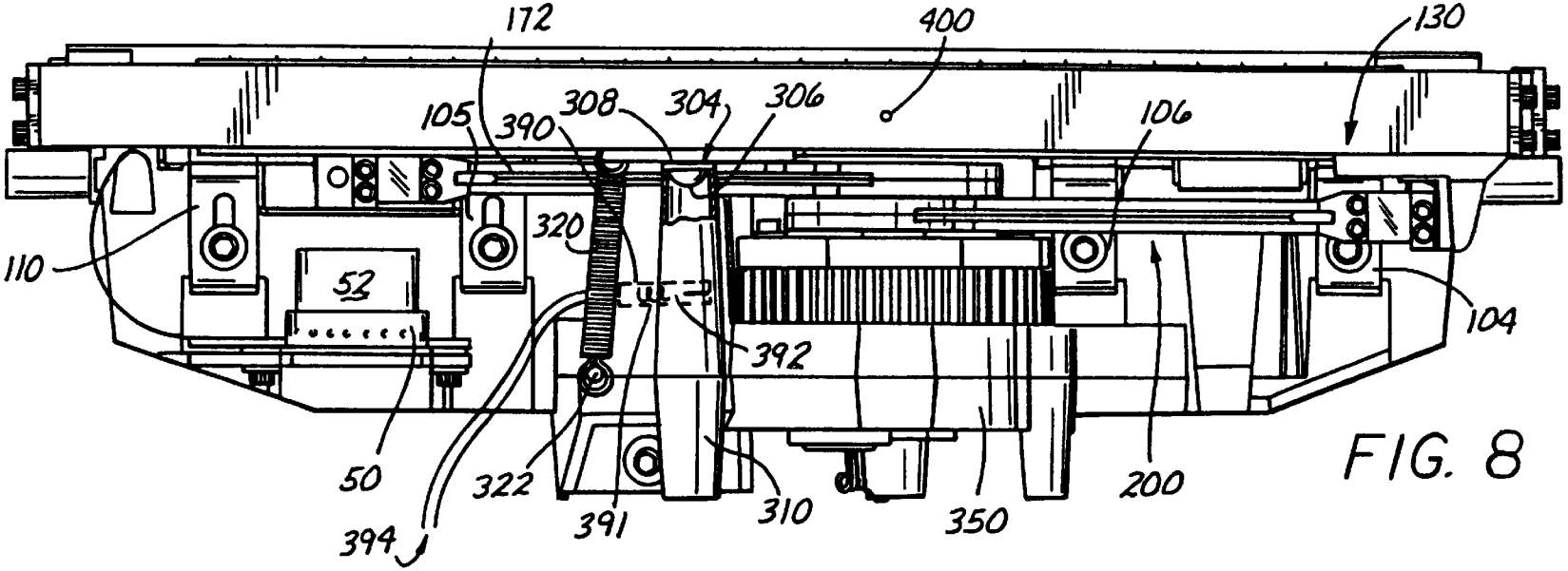
FIG. 8 comprises a top plan view looking downwardly at the printer of this invention.

The lands and grooves 380 and 382 provide for detection of movement and orientation by a magnetic detector that is shown in dotted outline form in FIG. 8. Namely, a detector 390 having a permanent magnet 392 connected to leads 394 detects the rotational movement of the flywheel 364. Every time a land 380 passes, the magnetic orientation between a permanent magnet 392 and a coil 391 causes a signal to be generated on leads 394. These signals or pulses are then directed toward the logic of the system in order to determine where the flywheel 364, forming the rotor and attendant portions of the crank or shaft 230 attached to the hammerbank to 22 are oriented. This function will be explained in greater detail hereinafter.

Although, a magnetic sensor 390 has been shown with a coil 391 and permanent magnet 392, it should be appreciated that other types of sensors can be utilized. Such sensors can incorporate Hall effect sensors, optical pickups, laser telemetry, RF sensors, and various reflective or wave oriented sensors with regard to movement of the flywheel 364 of the rotor. Also, it should be appreciated that the orientation of the flywheel 364 and rotor at the outside is particularly advantageous in this respect, in that it allows for the stator 356 to be emplaced therein with the magnetic ring 360 surrounding it.

The initial start-up of the printer with the shaft 230 turned by the motor causes it to rotate to approximately 250 to 300 rpm afterwhich the pickup pulse by the sensor 390 becomes more stable. The pickup pulse orients the flywheel 364 and drive with regard to the enlarged space, gap or groove 386. Detection by the logic of the circuit determines where the orientation of the printer is as to the crank or shaft 230 and of course attendant relationships of the hammers 24 on the hammerbank 22. This will be detailed as to the motor and its start-up procedures, and logic control.

The flywheel 364 and the remaining portions of the rotor are dynamically balanced. This is done by compensating for the lesser material in the gap or groove 386 being offset by removing material from the flywheel at a point opposite from where the gap 386 is.

Figure 9:
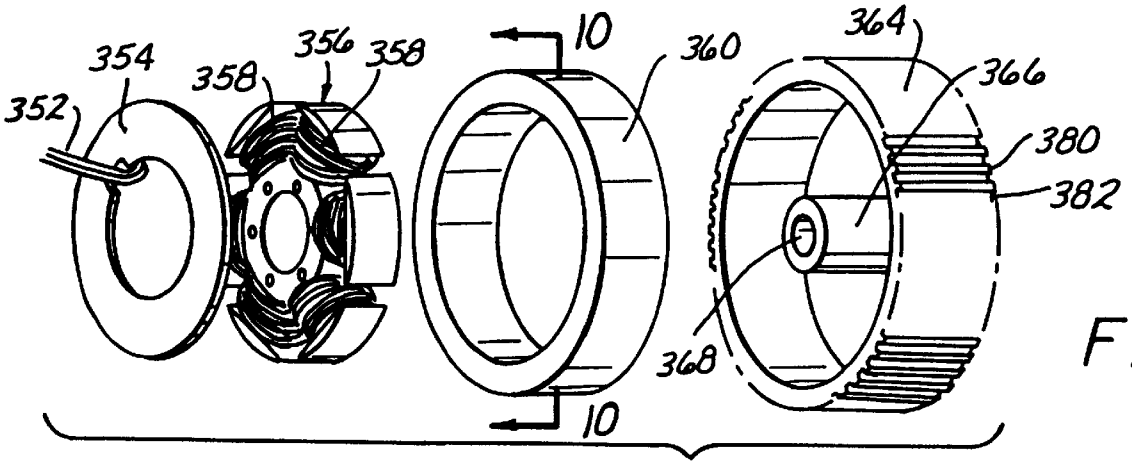
FIG. 9 shows an exploded view of the integrated motor and flywheel of this invention.

The motor as shown in FIGS. 9, 10, and 11 operates on an open loop basis until the proper timing is sensed. It then operates on a completely closed loop basis so that it moves in correspondence to the printing duty requirements in order to move the hammerbank 22 to release the respective hammers 24 at the appropriate point so that impact upon the part of the print tips 64 is at the right location with regard to the underlying print media.

When considering the fact that the motor is directly connected to the shaft 230 which is in turn directly connected by a mechanical linkage through the cams 232 and 234 to the respective drive shafts, it can be seen that the hammerbank 22 is in directly driven relationship to the orientation of the motor. When the hammerbank 22 is positioned at a particular position and the motor is keyed thereto by its direct mechanical connections, it can be seen that if a sensing of where the motor is determined, that an exact sensing of the placement of the respective hammers of the hammerbank 22 can be determined. This in turn allows for the hammers 24 to fire correctly if a particular orientation of the motor can be established. With this assumption of the particular direct linkage, if one knows the orientation of the rotor, one will then know respectively the orientation of the hammers 24.

Taking this particular supposition, the orientation of the motor can now be seen to be tied to the position of the hammerbank through the direct mechanical linkage.

In order to position the hammerbank 22 and the motor in a relatively known starting position, the hammerbank is initially held and retained in a central position. This central position is achieved by means of the spring 320 and the leaf springs at either end namely springs 144 and 146 positioning the hammerbank 22 in a relatively central position or at least in the position in which the springs 320 and the leaf springs 144 and 146 bias it to. With this known biased position, the motor can then be started. Based thereon, that particular position can then be oriented correctly with response to the particular motor position.

Looking more specifically at FIGS. 9, 10, 11, 12, and 13, it can be seen that the motor is shown with its respective functioning elements and logic control.

When looking at the magnetic ring 360 of FIG. 10, it can be seen that it is divided into six magnetically oriented segments. Starting at the twelve o'clock position or point 600, it can be seen that a south north orientation of the magnetic ring is positioned there. Within sixty degrees (60°) clockwise, the polarity changes from the outside to the inside to north south at position 602 which is approximately sixty degrees (60°), from the point 600.

Going around the ring 360, it can be seen that the orientation then changes every sixty degrees (60°) from south north to north south in polarity until the twelve o'clock position or top position is seen at point 600.

These particular south north to north south positions are such wherein they cause the magnetic ring 360 which is attached to the outer portion of the rotor 364 which is characterized as a flywheel to move when the coils 356 are excited.

Coils 356 are excited in a manner so that they respectively are tied together through their connections as seen in FIG. 11. In particular, the coils 358 can be seen as a first coil 606 connected with a second coil 608 one hundred and eighty degrees (180°) therefrom. A third coil 610 is connected to a fourth coil 612 that is in turn one hundred and eighty degrees (180°) from the coil 610. Finally, a fifth coil 614 and a sixth coil 616 are connected one hundred and eighty degrees (180°) apart. These respective connections can be seen as the connections, terminals or lines 618, 620, and 622 that comprise those connected to or forming lines 352.

Coils 606 through 616 can also be connected as pairs of coils shown in FIG. 11 as to the Y or Delta connections. The Y configuration is shown with the equivalent coils connected to lines A, B, and C of the motor which are equivalent to lines 618, 620 and 622 of the enlarged stator of FIG. 11. It should be appreciated that when referring to coils in this specification, the term is inclusive of motor windings. The Delta connection would also be connected through terminals A, B, and C equivalent to terminals 618, 620 and 622.

When lines or terminals 618, 620, and 622 are energized, they impart power to the respective coils which they are connected to. This allows for three particular energy pulses to direct six respective coils for improved smoothness and sensitivity and torque for driving the motor that comprises the ring 360 and outer rotor or flywheel portion 364. In this manner, when energy is applied to connection or terminal 618 it energizes coils 606 and 608. When energy is applied to line or terminal 620 it energizes coils 610 and 612. When energy is applied to line or terminal 622 it energizes coils 614 and 616. These particular lines are connected as previously stated to a circuit board 354 that serves as a connection for the coils 358 on lines 352 which represent those lines connected to lines or terminals 618, 620, and 622 as shown in FIG. 9.

Since the sensor 390 is a variable reluctance magnetic sensor, it requires that the motor be moving at a rate of about 250 to 300 revolutions per minute (rpm). This is in order for the sensor 390 to be able to fully detect the speed of the rotor from the flywheel 364. This in turn is indicative of the movement of the hammerbank 22 and allows for the motor to make a complete revolution to detect the position of the shuttle.

The mechanical movement of the hammerbank 22 with its counterbalance 130 (the shuttle) is such where it creates a difficult analytical variable from the standpoint of the loading of the motor since it is continuously changing. In effect, the shuttle drive comprising the motor and the remaining linkages have to be able to start the hammerbank 22 and counterbalance 130 (the shuttle) without discretely knowing the position of the components.

Generally stated, in order to effectuate controlled movement, the drive at the time of starting provides for a large amount of current through one of the motor coils, for example one of the pairs, such as pair 606 and 608 with the other pairs connected respectively to lines 620 and 622. This causes the motor to rotate to a known position and stop. The shorting of the other two pairs of coils causes the motion to be dampened and helps remove oscillations. This is particularly important inasmuch as the hammerbank 22 and counterbalance 130 are placed in a sprung mode so that they can oscillate to some degree. After holding the motor still for an instant, the current is driven through the next pair of coils, causing the motor to rotate and bend the springs holding the counterbalance namely those springs seen as springs 144 and 146. When the motor has turned one quarter turn, the springs are fully bent and start to spring back thereby accelerating the shuttle.

The stator in the form of the coils 356 also shown in FIG. 10 commutate after startup at a faster rate until the motor is moving fast enough for the sensor 390 to detect the motor speed and long enough for the sensor to detect the motor position. After the sensor 390 detects both the appropriate speed and position, then the drive changes from an open loop mode to a closed loop mode. A micro-controller or digital hardware then uses the information from the sensor 390 to drive the motor in an efficient manner.

Figure 12A:
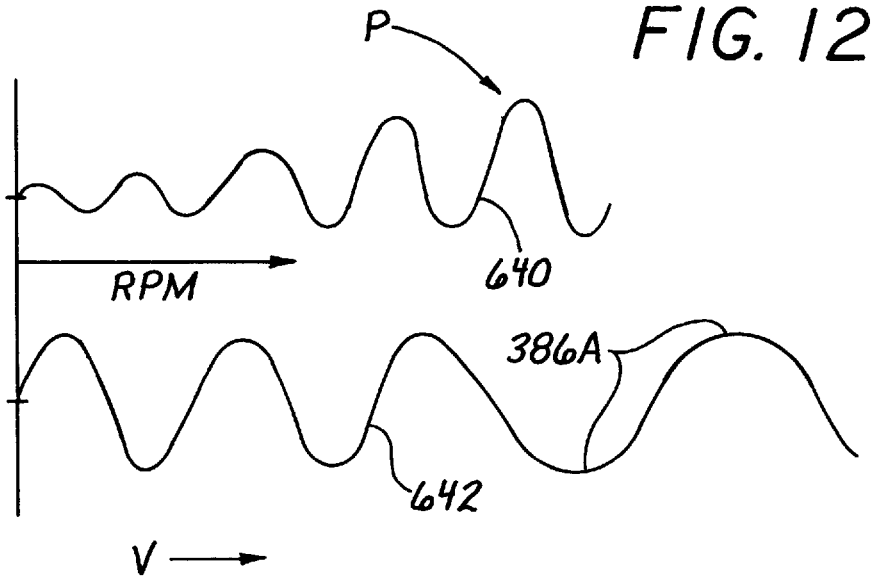
FIGS. 12A and 12B show a trace of the output of the magnetic sensor sensing the position of the rotor of the motor of this invention.
Figure 12B:
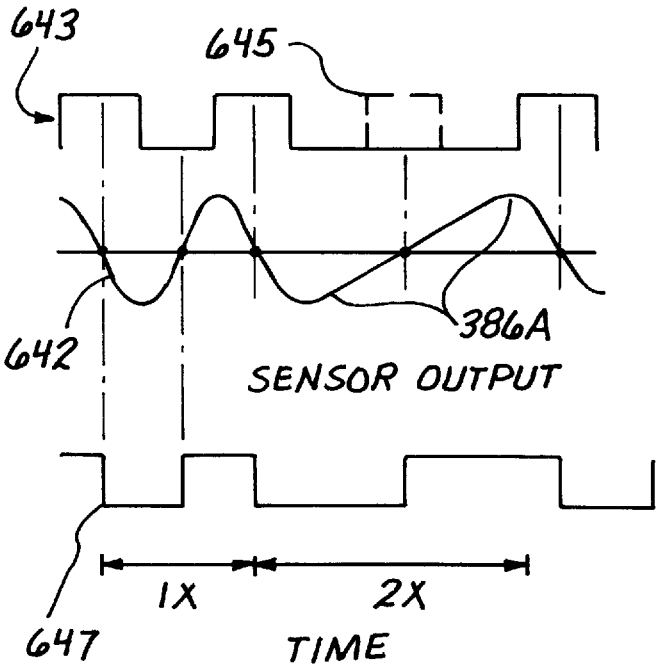

Looking more specifically at the way this is carried out, it can be seen that FIG. 12 shows a trace of the pulses or relative voltage outputs from the sensor 390. At start-up, the pulses as seen on trace 640 are relatively weak as measured with respect to velocity (v) of the rotor flywheel 364 from start-up. These pulses 640 tend to get larger based upon the magnetic output due to the lands 380 of the rotor flywheel 364 going faster thereby creating a larger change of flux through the magnetic sensor 390. In effect, the coils of the magnetic sensor 391, as energized by the relative change in the magnetic flux through the magnet 392 as the lands 380 pass, increases the voltage or pulsed output with the increasing higher speed of the motor. The increased higher motor speed also increases the frequency of the pulses from the lower frequencies of magnetic changes to the higher magnetic frequency changes as the motor speeds up.

Upon sufficient velocity (v) of the motor to the point where it puts out a high enough detectable signal beyond the point of zero voltage, the signal can then be properly read. Generally, this is in the neighborhood, with the magnetic sensor, of being 250 to 300 rpm for the rotor or flywheel 364. This peak voltage (P) can be seen as shown on trace 640. It should also be noted that the signal trace 640 increases from a low frequency and low amplitude to a high frequency and higher amplitude signal as the motor speed (RPM) increases.

When trace 640 of the voltage pulses are sufficiently high at the point (P), the pulses are then utilized as signals 642 as shown in the lower trace. At such time, the position of where the gap 386 is read shows the particular position of the rotor with flywheel 364 of the motor. This gap is shown as the gap 386A of the usable voltage or pulses 642. This indicates the position of the motor and of course the relative position of the hammerbank 22 with the hammers 24 thereof. Gap 386A has a positive and negative amplitude because of the nature of the variable reluctance magnetic sensor 390 imparting a signal with a wave form being an analog sinusoid.

The wave form of the variable reluctance magnetic sensor 390 is squared up with a voltage comparator to provide a square wave form 643 having highs and lows that somewhat correlate to the zero crossing of the wave form 642. The output 645 of the voltage comparator as to the missing tooth or enlarged groove 386 is shown with respect to the wave form 642. This allows the signal to be digitized in a usable format.

The time domain is shown for the wave form 642 in the form of the time line trace 647 wherein the timing of the output based upon the enlarged gap or groove 386 is twice that of the remaining lands and grooves.

The foregoing outputs can then be reviewed such that when the hammerbank 22 and counterbalance 130 (the shuttle) are in a known position at power-up of the printer, the process for orienting the hammers 24 can begin. This is based upon the known position derived from the spring bias due to springs 320 and leaf springs 144 and 146. At this point, the respective coils connected to connections or terminals 618, 620, and 622 are driven to cause the motor to move.

For instance if those coils 606 and 608 connected to terminal or line 618 are first started, then those coils 610 and 612 connected to connection or terminal 620 are energized thereafter to cause the rotor 364 and ring 360 to begin to turn. They then move in a predictable manner because of the fact that the position is known based upon the characteristics of the electrical and mechanical elements all being linked together.

In the subsequent step, the next coils 614 and 616 are driven as connected to connection or terminal 622. Based upon the mechanism, the inertia, and the motor torque accelerating, the motor then reaches a theoretical speed. This theoretical speed is fast enough to give valid pulses out of the magnetic sensor pickup unit 390.

At this time, it is then determined whether or not the pulse is at a proper peak (P) for reliable signals. As the pulses reach the peak point (P) of the trace 640 they can then reliably determine the position of the gap 386A through the gapped pulses or expanded low orientation of the double lack of a pulse or gapped trace 386A.

Thereafter, the pulses are counted to determine the rotor placement based upon the long or skipped pulse 386A. The coils on terminals or lines 618, 620, and 622 are then driven in a closed loop mode based upon the rotor position.

Looking more specifically at FIG. 13, it can be seen wherein the logic of the system is shown.

In the previous example, the printer is started up. Thereafter, the first coil such as those coils 606 and 608 are driven in their connected relationship to line 618. A delay is then set. Thereafter, a determination of the time equaling the delay is determined. If time equals time minus one, the system proceeds. If the respective outcome of this step is such where time equals zero, the next coil is driven such as those coils connected to line 620, namely coils 610 and 612. If not, the system starts back at the time delay.

If the delay is correct, the system will then go forward to measure the frequency of the magnetic pickup unit or sensor 390. If the signal is not correct it will then go back to a starting mode because of the fact that the motor is out of sequence as to the respective portion of the pickup 390. Assuming it is correct, it then goes on to look for the long pulse or double gapped pulse 386A. If it finds the long pulse, it then continues on into a closed loop mode driving the coils connected to lines 618, 620, and 622 based upon the rotor position detected by the magnetic pickup unit or sensor 390.

The foregoing establishes through the controller of the printer the position of the rotor with the flywheel 364 and the magnetic ring 360. Since the drive is a direct drive, a determination can be made of the position of each respective hammer 24 based upon the position of the rotor in its positioning with the magnetic pickup unit or sensor 390. This enhances the functions of the overall system and unit to the point where the magnetic pickup unit or sensor 390 can take on the function of providing for the exact location and orientation of the hammerbank 22 as keyed to the motor with respect to the double pulse or gap 386A.

The integral motor shaft and flywheel 364 create a situation wherein dynamic forces are reduced significantly. Of particular consequence is the fact that the center of gravity of the hammerbank 22 and the counterbalance 130 (the shuttle) is placed at the position of the axis of the crank or shaft 230 such wherein the center of gravity is at approximately point 400. This causes dynamic forces to be diminished from the standpoint of the counterbalance and hammerbank orientation of the unit.

Another point to note is that the assembly is dynamically balanced so that the weight of the flywheel 364 is placed to optimize inertia while at the same time allowing smooth overlying operation of the hammerbank 22 and the counterbalance 130 (the shuttle). The particular relationship of the integral hammerbank 22 with the overlying counterbalance and the movement of the center of gravity at point 400 as closely as possible to the shaft 230 axis improves the overall performance. Furthermore, with the rotor comprising ring 360 and flywheel 364 integral to the inside out motor, a substantial amount of inertia is maintained to enhance the angular velocity and smoothness.

It should be specifically noted that the connecting rods 172 and 200 are in as close proximity as practical with regard to the spacing and adjacent relationship to the combined hammerbank 22 and counterbalance 130 (the shuttle). This close proximate spacing and orientation of the center of gravity 400 allows for a smooth operation and avoids the placement of the connector rods 172 and 200 outside of the balanced reciprocal orientation in which they are connected to the respective hammerbank 22 and counterbalance 130 (the shuttle).

From the foregoing, it can be seen that the invention hereof is a substantial step in the art to provide significant improvement over those printers known in the art and particularly with regard to the line printer art. Accordingly, the invention should be accorded the scope of the following claims as set forth hereinafter.

We claim:

1. A dot matrix printer comprising:

a plurality of hammers forming in part a hammerbank;

a motor means for driving said hammerbank;

means for releasing said hammers for printing on a print media;

a counterbalance having at least a portion underlying said hammerbank mechanically linked to said hammerbank;

lands and grooves connected for rotation directly on said motor means;

a sensor comprising a magnetic sensor for sensing the lands and grooves;

means for linking the position of said lands and grooves to the position of said hammerbank; and, means connected to said sensor for reading pulses therefrom after a prescribed speed of rotation of said motor has been achieved.

2. The printer as claimed in claim 1 further comprising:

means connected to said sensor for determining the position of the motor in relation to said expanded groove; and, means connected to said hammerbank for firing said hammers so the hammers thereof are fired with respect to the position of the motor in relationship to the expanded groove.

3. The printer as claimed in claim 1 further comprising:

means for driving current through one coil of the motor while shorting the remaining coils for initial open loop mode driving of the motor.

4. The printer as claimed in claim 1 further comprising:

means for driving the motor in a closed loop mode after driving the motor in an open loop mode.

5. The printer as claimed in claim 1 further comprising:

a first crank arm connected to said hammerbank;

a second crank arm connected to said counterbalance; and, means for rotating said crank arms 180° apart in substantially parallel and proximate relationship to each other.

6. The printer as claimed in claim 5 further comprising:

a motor for turning said crank arms;

a shaft extending from said motor; and, eccentric means on said shaft and respectively connected to said first and second crank arms for rotating said crank arms.

7. A line printer comprising:

a hammerbank having a plurality of hammers with tips at the ends thereof supported for reciprocal movement for printing on a print media;

a counterbalance connected to said hammerbank having at least a portion thereof in parallel adjacent lateral relationship to said hammerbank;

a drive motor for said hammerbank and counterbalance having a flywheel;

a shaft in connected relationship to said drive motor connected to said hammerbank and said counterbalance for movement of said hammerbank and counterbalance in response to rotational movement of said shaft;

said motor having a rotor with a stator on the inside thereof;

shaft connection means between said rotor and said shaft;

a plurality of lands and grooves on said rotor; and, a magnetic detector for differentiating differences between said lands and grooves.

8. A method for driving a line printer having a plurality of hammers on a hammerbank for printing on an underlying media comprising:

providing a motor having a stator on the inside and a rotor on the outside with multiple coils connected to said hammerbank for movement of said hammerbank in response to said motor;

providing lands and grooves on the rotor;

energizing one of said coils with a current at startup of the motor;

shorting the remaining coils of the motor;

rotating said motor to a known position;

driving the motor through a subsequent coil;

detecting the position of the motor by the differences between said lands and grooves in the form of pulses while at the same time linking the position of the motor to the position of the hammerbank; and, controlling said motor and said hammerbank with regard to said pulses.

9. The method as claimed in claim 8 further comprising:

providing a series of said lands and grooves with at least one enlarged groove; and, detecting the position of said motor by sensing said enlarged groove.

10. The method as claimed in claim 8 further comprising:

providing a series of said lands and grooves with at least one enlarged land; and, detecting the position of said motor by sensing said enlarged land.

11. The method as claimed in claim 8 further comprising:

turning said motor initially; and, biasing said hammerbank at the end of said initial turn for movement in the opposite direction.

12. The method as claimed in claim 11 further comprising:

decreasing the current of said coils of said motor after said motor has turned initially and said hammerbank is moving in the opposite direction; and, commutating said stator at an increased rate thereafter.

13. The method as claimed in claim 8 comprising:

initially driving said motor in an open loop mode and thereafter in a closed loop mode.

14. A method of driving a dot matrix printer comprising:

providing a plurality of hammers forming in part a hammerbank;

providing a motor for driving said hammerbank;

providing means for releasing said hammers for printing on a print media;

counterbalancing said hammerbank by a counterbalance in adjacent parallel lateral relationship with said hammerbank;

providing lands and grooves directly on said motor for rotation with said motor;

driving a first coil of said motor;

measuring the frequency of pulses derived from the rotation of said lands and grooves;

driving said motor in an open loop mode; and, driving said motor thereafter in a closed loop mode after driving said motor in said open loop mode.

15. The method as claimed in claim 14 further comprising:

maintaining said hammerbank initially in a fixed position by spring biasing means.

16. The method as claimed in claim 14 further comprising:

providing an enlarged land or groove within said lands and grooves;

providing a magnetic sensor for sensing said lands and grooves;

providing an output from said lands and grooves for determining the expanded land or groove to provide a longer pulse;

determining the position of said longer pulse; and, controlling the position of said hammerbank based upon said longer pulse.

17. The method as claimed in claim 16 further comprising:

rotating said motor to a prescribed rotational speed; and, sensing pulses thereafter from said lands and grooves.

18. The method as claimed in claim 17 further comprising:

providing a magnetic sensor for detecting pulses derived from said lands and grooves.

19. The method as claimed in claim 18 further comprising:

detecting said lands and grooves with regard to the pulses of only a pre-established magnitude.

* * * * *